US005667326A

United States Patent [19]

McGaffigan

[11] Patent Number: 5,667,326

[45] Date of Patent: Sep. 16, 1997

[54] FLEXIBLE TIE STRUT

[76] Inventor: Thomas H. McGaffigan, 19089 Brookhaven Dr., Saratoga, Calif. 95070

[21] Appl. No.: 605,159

[22] PCT Filed: Sep. 6, 1994

[86] PCT No.: PCT/US94/09992

§ 371 Date: Mar. 6, 1996

§ 102(e) Date: Mar. 6, 1996

[87] PCT Pub. No.: WO95/07416

PCT Pub. Date: Mar. 16, 1995

Related U.S. Application Data

[63] Continuation-in-part of Ser. No. 118,492, Sep. 7, 1993, Pat. No. 5,433,549.

[51] Int. Cl.[6] ..... F16B 7/00; A63H 33/00; B60B 37/00

[52] U.S. Cl. ..... 403/176; 403/169; 403/171; 403/348; 446/119; 446/126; 301/118; 301/111; 301/131

[58] Field of Search ..... 446/126, 123, 446/119, 122; 52/655.2, 655.1, 646, 653.1, 81.3; 135/106, 101, 102, 105; 403/169–171, 176–178, 217, 396, 389, 348, 349, 203, 41, 202, 220, 223, 229, 291; 16/225, 226, 286, 298, 392, DIG. 33; 301/118, 111, 112, 126, 131

[56] References Cited

U.S. PATENT DOCUMENTS

| | | | |
|---|---|---|---|
| Re. 7,114 | 5/1876 | Wild . | |
| 1,113,371 | 10/1914 | Pageau | 446/126 |
| 1,608,592 | 11/1926 | Funk | 446/126 |
| 1,707,691 | 4/1929 | Sweet | 446/126 |
| 1,843,115 | 2/1932 | Ferris | 446/126 |
| 2,363,785 | 11/1944 | Gold | 446/486 |
| 2,509,100 | 5/1950 | Jordan | 254/134.3 FT |
| 2,509,115 | 5/1950 | Wait et al. | 254/134.3 FT |
| 2,530,964 | 11/1950 | Hhirsch . | |
| 2,559,160 | 7/1951 | Jacob | 254/134.3 FT |
| 2,709,318 | 5/1955 | Benjamin | 446/103 |
| 2,880,435 | 4/1959 | Deutsch et al. . | |
| 3,286,391 | 11/1966 | Mengeringhausen | 446/120 |
| 3,397,420 | 8/1968 | Schneider . | |
| 3,458,949 | 8/1969 | Young . | |
| 3,648,404 | 3/1972 | Ogsbury et al. | 446/112 X |
| 3,864,049 | 2/1975 | Ono | 403/171 |
| 3,882,650 | 5/1975 | Gugliotta . | |
| 3,918,196 | 11/1975 | Schleich | 446/126 X |
| 4,020,566 | 5/1977 | Dreiding | 446/125 X |
| 4,078,328 | 3/1978 | Rayment | 446/126 X |
| 4,193,639 | 3/1980 | Pauly et al. | 446/465 |
| 4,246,718 | 1/1981 | Chatani | 446/121 |
| 4,302,900 | 12/1981 | Rayner | 446/120 |
| 4,758,196 | 7/1988 | Wang | 446/117 X |
| 4,840,599 | 6/1989 | Ming | 446/465 |
| 4,958,474 | 9/1990 | Adams . | |
| 4,963,115 | 10/1990 | Davin et al. | 446/96 |
| 5,061,219 | 10/1991 | Glickman | 446/126 |
| 5,137,486 | 8/1992 | Glickamn | 446/126 |

FOREIGN PATENT DOCUMENTS

| | | |
|---|---|---|
| 1339636 | 9/1963 | France . |

*Primary Examiner*—Anthony Knight

*Attorney, Agent, or Firm*—Burns, Doane, Swecker & Mathis, L.L.P.

[57] ABSTRACT

A flexible tie strut for supporting both compressive and tensile forces, the flexible tie strut includes a tension member and a coaxially mounted compression member, the compression member and the tensile member are interconnected at their respective ends. A coupler for interconnecting flexible tie struts, and a system of couplers and struts are also disclosed. Additionally, wheels are disclosed that have axles having both male and female connection means.

10 Claims, 9 Drawing Sheets

FLEXIBLE TIE STRUT

This is a continuation-in-part application of U.S. patent application Ser. No. 08/118,492, filed Sep. 7, 1993, now U.S. Pat. No. 5,433,549, issued Jul. 18, 1995.

FIELD OF THE INVENTION

The present invention is directed to a construction system, especially useful as a construction toy, display stand, instructional engineering aid and more particularly to a novel and improved type of flexible tie strut. The present invention also relates to couplers for connecting structural members and collapsible, self-erecting construction structures.

PRIOR ART

The range of construction toys available today for children older than six years is small and generally unappealing. There are two major problems associated with this section of the toy market. First, the short attention span of many of today's television-oriented children requires a toy to provide immediate gratification—the 'push-together' ease of the Lego™ is now a minimum standard. Second, there is considerable buyer resistance to construction toys which manifestly do not contain sufficient components to build the impressive models so often seen in shop-window displays and advertising literature and when they do, they are fragile not durable.

Although examples of toys are discussed in detail it is understood that the present invention is directed to construction systems in which the primary types of structural members are beams, ties and struts. Beams are those members that are subjected to bending or flexure. Ties are members that are subjected to axial tension only. Struts are members that are subjected to axial compression only. The present invention is able to support tension and compression loads and in addition, is flexible and collapsible. After being collapsed and bent, the flexible tie strut is able to elastically recover to it's original form.

A variety of construction toys having combinations of connectors and structural elements acting primarily as struts which can be combined to form various structures is generally known. The structural elements of the known construction toys generally do not accommodate tensile loads or allow recoverable bending along their longitudinal axis. Such known elements seriously limit the size and strength of structures that can be assembled from them.

If a large structure is fabricated from existing combinations of connectors and structural elements, such a structure can easily be damaged from the application of small loads. The reason for this is, the application of a relatively small load can cause significant bending stress to be developed in the struts, thus damaging them. The present invention is designed to support only compressive and tensile loads and cannot support excessive bending loads. This feature of not being capable of supporting excessive bending loads not only prevents damage in the event of overload of the structure, but also permits the structure to be collapsed and stored for later self-erection.

U.S. Pat. Nos. 5,137,486 to Glickman and 2,709,318 to Benjamin are typical of construction toys having hub-like connectors and strut-like structural elements adapted to be removably engaged, e.g., force fit, with the connectors to form composite structures. In general, none of these prior art devices provides positive coupling of strut-like members to withstand tensile loading, and none provides strut-like members with strength in tension and compression. In addition, none of the strut-like members in the prior art allows controlled flexure for purposes of assembly or the creation of self-erecting structures.

In U.S. Pat. No. 2,976,968 to Fentiman, an attempt is made at producing a construction system which is able to load the strut members in tension and compression, but this design is susceptible to damage due to the rigid nature of both the struts and the coupler.

In U.S. Pat. No. 4,302,900 to Rayner and also U.S. Pat. No. 3,286,391 to Mengeringhausen, a flexible connection means is disclosed. This connection means is able to accommodate a certain amount of abuse, but because the strum in both of the aforementioned patents are rigid, they are easily damaged if subjected to bending loads as might occur if they were to be stepped on. The present invention cannot be damaged in this way since it cannot support excessive bending loads, and thus cannot be damaged by them.

Because of the limitations of existing construction systems the following criteria were considered in the design of the subject invention:

- Maximum versatility of each pan (as discussed above) to provide the largest possible variety of structures is desirable
- No tools are required for assembly
- Rapid assembly and disassembly are desirable
- Engineering principles are illustrated as graphically in this invention as bricklaying systems can be illustrated with block systems
- Random or violent disassembly must not damage the parts
- Tenacity of connections must not be dependent on close tolerance interference fits which may be affected by wear
- Parts must be large enough to not be easily lost
- Sharp edges and corners must be eliminated to prevent soreness to fingertips after an extended period of use
- Completed structure must be collapsible and capable of re-erection In view of the limitations of prior art devices and, in general, the many primary types of structural elements required to build structures, it would be highly desirable to have one building element that would be selectively flexible (even recoverable) and have sufficient strength in tension and compression in order to build any size structure. It would also be desirable to have a unique coupler for positively locking with such a novel building element.

SUMMARY OF THE INVENTION

The purpose of the subject invention is to provide a construction system having elements which are flexible and recoverable along their longitudinal axis and which support tensile and compressive loads. To accomplish this purpose there is provided a construction system having a unique building element which is a flexible tie strut (hereinafter also referred to as "FTS") comprising a tension member and a co-axial compression member, the members being connected to each other at their respective ends. The tension member is preferably a flexible cable-like member which provides resistance to tensile forces that may be applied along the longitudinal axis of the FTS. The compression member is a one-piece or multiple-piece elongated member which is flexible about its longitudinal axis and which is substantially incompressible along its longitudinal axis when subjected to axial compression. The compression member is preferably a helical spring, the coils of which allow flexing of the spring but which contact each other and become incompressible when the spring is fully loaded. The novel combination of the tension member and compression member being connected to each other at their respective ends allows the FTS to bend along its length, to return to a straightened shape upon release of bending forces and to withstand tension and compression. In addition, the FTS may be designed to buckle at a predetermined compressive load by either varying the diameter or length of the compressive member or the initial preload on the tension member. In addition, the tension and compression member may be preloaded against each other to increase the stiffness of the FTS.

In one aspect of the invention is a flexible tie strut for supporting both compressive and tensile forces having a tension member being generally elongated, flexible along the length thereof and having first and second ends, said tension member providing resistance to tensile forces that may be applied to said first and second ends; and a compression member being generally elongated, flexible along the length thereof and having first and second ends, said compression member having a substantial portion thereof which is incompressible, said compression member providing resistance to compressive forces that may be applied to said first and second ends, said first end of said tension member being operatively connected to said first end of said compression member and said second end of said tension member being operatively connected to said second end of said compression member, at least one of said members having some compliance to allow flexibility of the flexible tie shut.

In another aspect of the invention there is provided a coupler having a body of two identical pieces, each piece having a perimeter and having an axis therethrough and being generally symmetrical about said axis, each piece having a portion of at least one cavity in the perimeter thereof, said pieces being connected together in mirror image fashion to form said body having cavities in the periphery thereof to form a two-dimensional connector.

In still another aspect of the invention there is provided a coupler having a body having a perimeter and at least one cavity, in said perimeter, said cavity having at least one tooth extending into said cavity to engage a connector means of a tie strut to be mated to said coupler.

In yet again another aspect of the invention there is provided a construction system having a flexible tie shut for supporting both compressive and tensile forces having a tension member being generally elongated, flexible along the length thereof and having first and second ends, said tension member providing resistance to tensile forces that may be applied to said first and second ends and a compression member being generally elongated, flexible along the length thereof and having first and second ends, said compression member having a substantial portion thereof which is incompressible, said compression member providing resistance to compressive forces that may be applied to said first and second ends, said first end of said tension member being operatively connected to said first end of said compression member and said second end of said tension member being operatively connected to said second end of said compression member, at least one of said members having some compliance to allow flexibility of the flexible tie strut; and a coupler for connecting struts, the coupler having a member having at least one opening for receiving a strut to be connected therein and a retaining means connected to said member and positioned within said opening for locking engagement with a strut to be connected.

In yet another aspect of the invention there is provided a self-erecting system comprising a flexible tie strut for supporting both compressive and tensile forces having a first connector means attached to the first ends of said tension member and said compression member and a second connector means attached to said second ends of said tension member and compression member to connect said flexible tie strut to objects to be connected and having a coupler having a body of two-identical pieces, each piece having a perimeter and having an axis therethrough and being generally symmetrical about said axis, each piece having a portion of at least one cavity in the perimeter thereof, said pieces being connected together in mirror image fashion to form said body having cavities in the periphery thereof to form a two-dimensional connector.

In still yet another aspect of the invention there is provided a self erecting system comprising a flexible tie strut wherein said connector means includes at least a portion of a circumferential resilient rib, said rib being deflected upon mating of said strut to said coupler.

In another aspect of the invention there is provided wheel assembly having a wheel assembly having at least one wheel having a rotational axis and having an opening therethrough concentric with said axis; and an axle-like member insertable within said opening, said axle like member having a connector means that is integral with each end thereof, said connector means being a quarter-turn connector at one end and a cavity having at least one tooth at the other end thereof.

DESCRIPTION OF THE DRAWING

In FIG. 3B, the compression member is a plurality of flat discs. In FIG. 3C, the compression member is a plurality of fitted (shown curved) discs.

FIG. 5B illustrates two identical coupler halves as seen in FIG. 5A bonded together.

FIG. 6A illustrates in exploded view two two-dimensional couplers as shown in FIG. 5B prior to interlocking to each other. FIG. 6B is an assembled three-dimensional coupler after interlocking of the two, two-dimensional couplers of FIG. 6A.

DESCRIPTION OF THE PREFERRED EMBODIMENTS

Figure 1A:
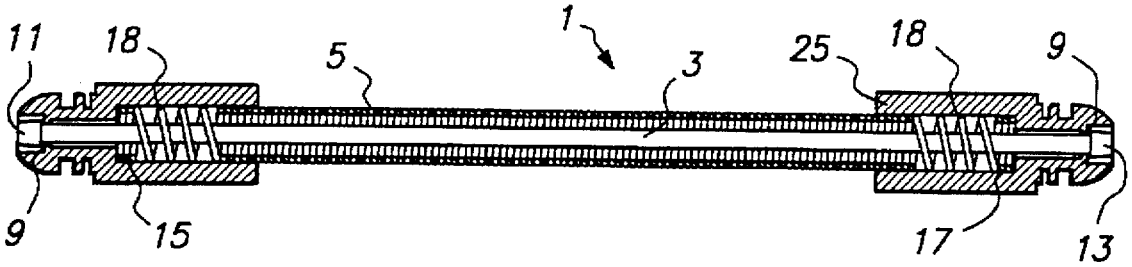
FIGS. 1A and 1B are partial cross-sectioned plan views of a FTS with a pair of connector means at each end thereof. Flexure of the FTS is shown in FIG. 1B.
Figure 1B:
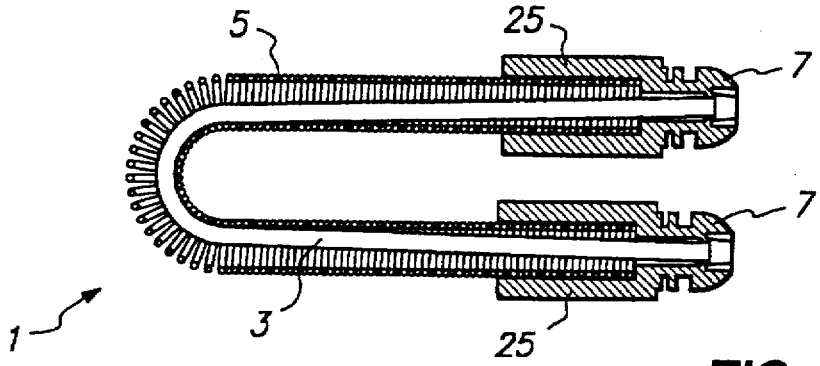

With continued reference to the drawing, FIGS. 1A and 1B illustrate the composite struts in accordance with the invention. Each assembly includes the FTS shown generally at 1 comprising tension member 3 and compression member 5. Tension member 3 and compression member 5 are operatively connected to each other at their respective ends by a pair of connector means 7 which also mates the FTS to objects to be connected. FIG. 1B illustrates the flexibility of the FTS.

Tension member 3 has a first end 11 and second end 13. Compression member 5 has a first end 15 and a second end 17. The first end 11 of the tension member is operatively interconnected to the first end 15 of the compression member 5, and the second end 13 of the tension member 3 is operatively interconnected with the second end 17 of the compression member 5. The cross-sectioned portions of FIGS. 1A and 1B illustrate operative interconnection of ends 11 and 13 of tension member 3 and ends 15 and 17 of compression member 5 by compliant sections 18 of compression member 5. One or both compliant (compressible) sections 18 of compression member 5 may be used to allow a greater range of flexibility of compression member 5. In FIG. 1B, the allowable compressibility of compliant sections 18 have been utilized by the flexure of the FTS.

Figure 2A:
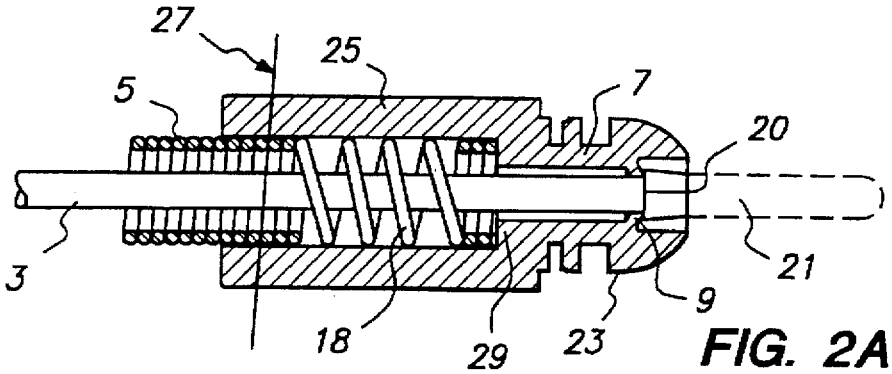
FIG. 2A is an enlarged cross-sectional view of one end of the FTS shown in FIG. 1A.

As can be seen more clearly in FIG. 2A, tension member 3 is shown to be a cable-like member, the ends of the cable-like member being preferably barbed at 20 to operatively engage collar 9 of connector means 7. As shown in FIGS. 1–4, knob means 25 can be integral or a part of connector means 7. Connector means 7 further includes end portion 23 for locking an assembled FTS to objects to be connected, as will be discussed later in greater detail. Connector means 7 also includes an integral knob portion 25 which allows manipulation and especially rotation of end portion 23 for purposes of coupling and locking assembled strut 1 to an object to be connected. It is understood that the ends of the tension member 3 and the compression member 5 may be operatively interconnected to support tensile and compression loads by equivalent means, such as crimping, soldering, welding, adhesives, etc., well known to one skilled in the art and are considered part of this invention. The connector means may be injection molded onto the first and second ends of the tension means.

Figure 2B:
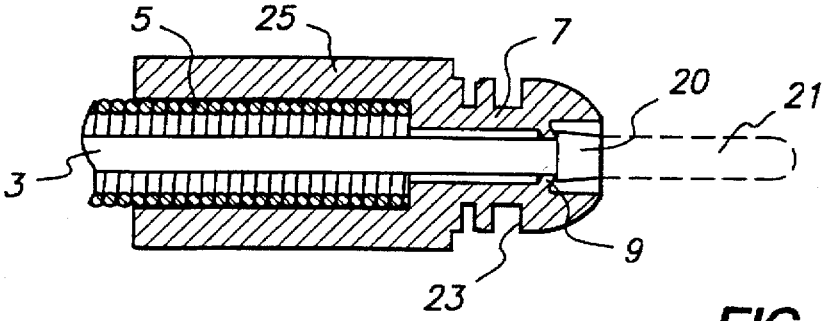
FIG. 2B is an enlarged cross-sectional view as in FIG. 2A of the end of the FTS as shown in FIG. 1B. An alternate embodiment of tensile member having a leader portion shown in phantom line is illustrated.
Figure 10A:
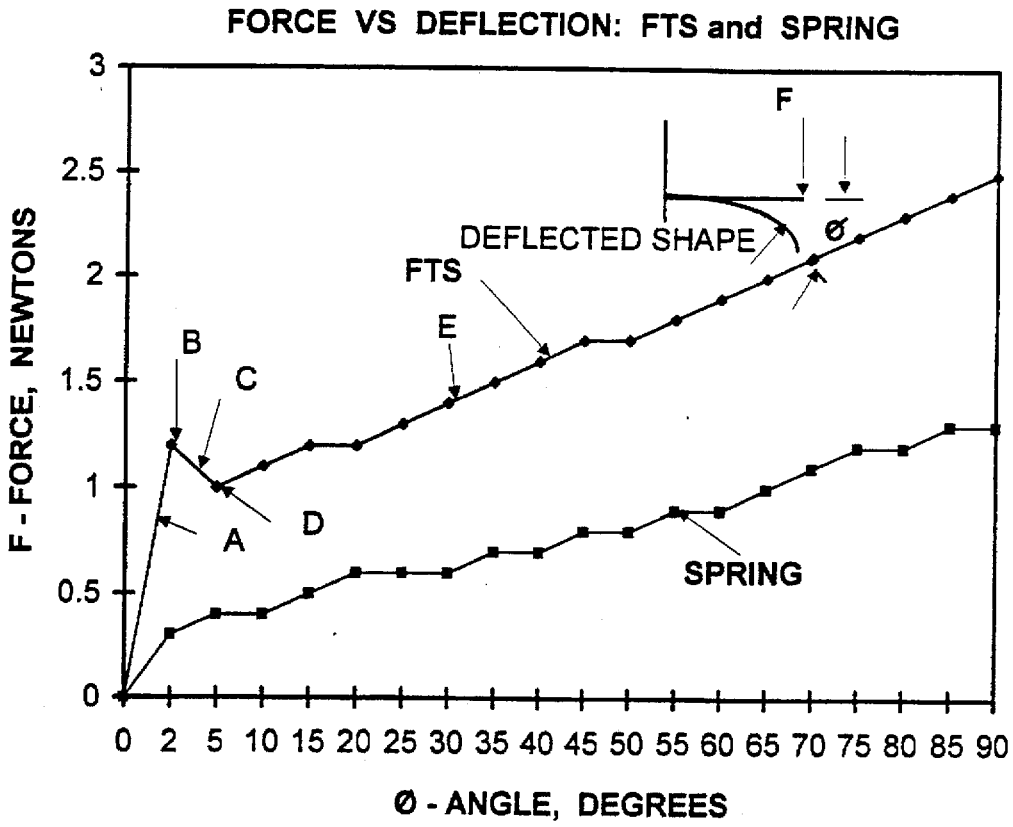
FIG. 10A is a graph of Force versus Angular Deflection of a FTS and of a simple spring when loaded as a single cantilever beam.
Figure 10B:
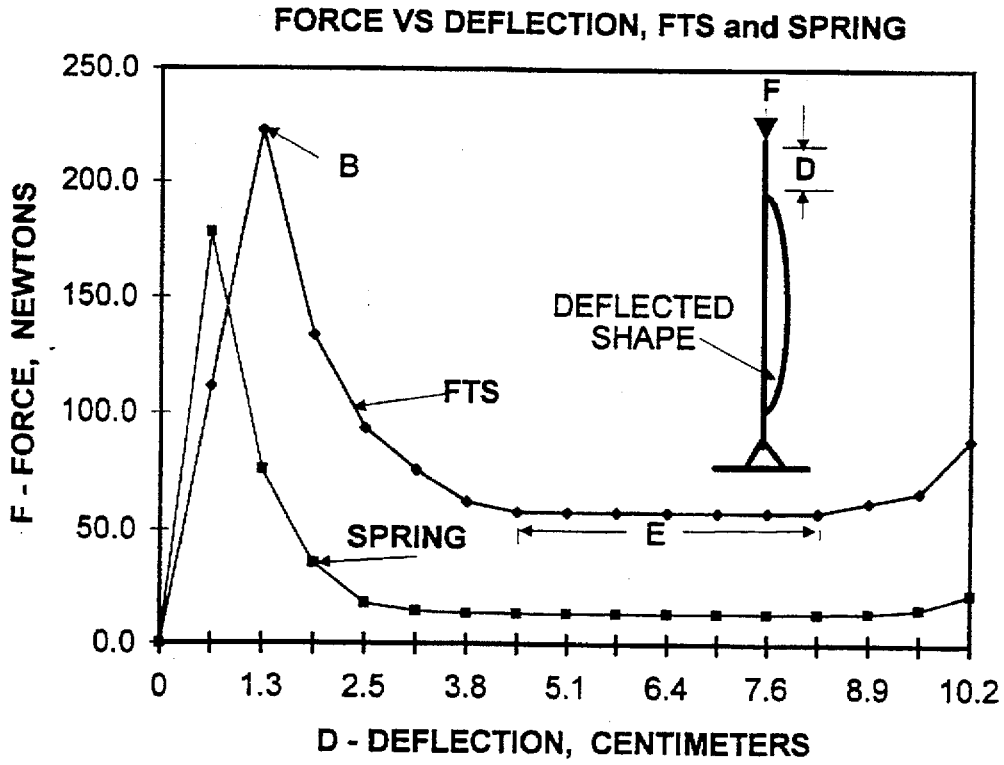
FIG. 10B is a graph of force versus deflection of an FTS and of a simple spring when loaded in column.

Flexibility of FTS depends upon either the compressibility of compression member 5 or the elasticity of tension member 3, or both. Compression member 5 is shown to be a helical spring-like member having coils which when fully compressed, i.e., when contacting each other, become the equivalent of a tube. The cross-section of such coils may be round, square, rectangular, etc. and may be segmented to vary along the axial length of the spring. If a external load compresses all of the coils of compression member 5 into contact with each other, as seen in FIG. 2B, then the FTS will become resistant to both tensile and compressive forces when used as a structural member. Various mechanisms to selectively apply tension to tension member 3 with respect to compressive member 5 are within the scope of the invention. By varying the preload between the tension and compression members the stiffness of the FTS can be tailored to a specific valve. FIGS. 1A–B, 2A–B, 3A and 4 illustrate alternative embodiments to adjust or control the interaction between tension member 3 and compression member 5. FIGS. 10A and 10B illustrate the effect of the additional stiffness of a FTS type of construction versus a simple spring. The simple spring does not incorporate a tensile member, thus cannot support significant tension loads or be preloaded to adjust it's stiffness.

The bending stiffness of a plain extension spring is determined by the amount of initial preload that can be wound into the spring during fabrication. This mount of preload is determined by the spring material properties, the spring dimensions and the spring winding parameters. Simply, as the spring is wound the coil being added is wound partially behind the existing coil. The extent that this can be accomplished without having the added coil on top of the existing coils determines the mount of preload due to winding parameters. As example a ¼ inch outside diameter spring made from 0.032 diameter hard drawn steel wire has a practical maximum initial preload of 1 pound. In other words at a load of 1 pound in tension the coils of the spring would just begin to separate. Thus a spring such as this, subject to a bending load would remain straight until this 1 pound limit between coils was reached and it's coils separated thus deflecting it.

Figure 11A:
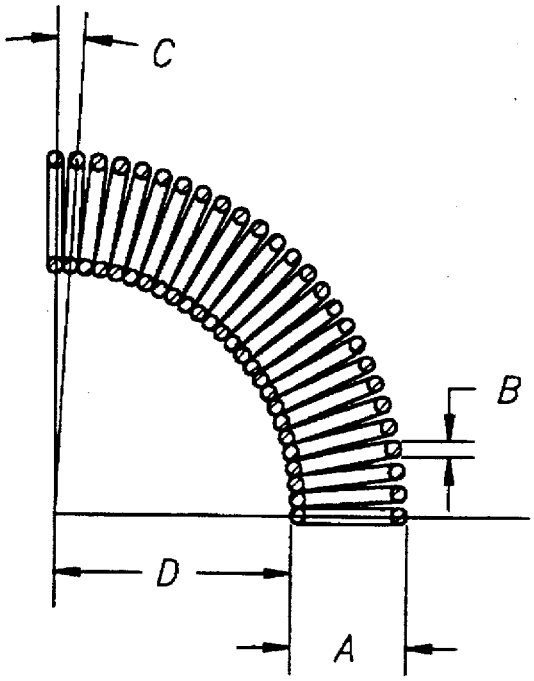
FIG. 11A is a cross-sectional view of a portion of an FTS spring compression member bent into a 0.500 inch bend radius.
Figure 11B:
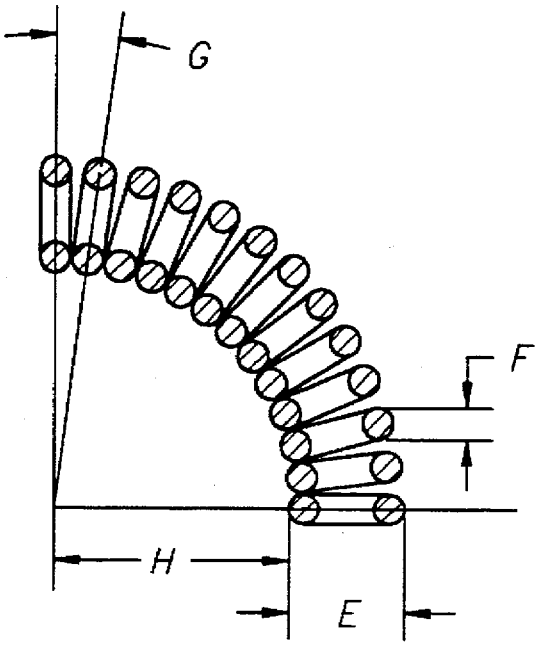
FIG. 11B is a cross-sectional view similar to FIG. 11A of a portion of a simple spring having the same preload as the FTS compression member shown in FIG. 11A and bent into the same 0.500 inch bend radius as the FTS in FIG. 11A.

The stiffness of the FTS utilizing a coilbound spring as the compression member is determined by the initial tension that is wound into the spring and the additional stiffness that may be added by preloading the compression and tensile members. For example if we take the same ¼ inch spring of the previous example and incorporate the compliant/preload section of the present invention, the allowable load would be much greater. For example the compression spring section of FTS made from the same 0.032 diameter wire, ¼ inch outside diameter, can support a maximum load of 10 pounds before it will yield due to torsional stresses developed in the wire. Thus if this 10 pounds of force is utilized to preload the coil bound portion of the FTS, it will now take; 10+1=11 pounds of force to separate the spring coils causing it to bend. This stiffness increase is achieved without sacrificing any flexibility since the spring configuration did not change. If a plain extension spring were designed to have same 11 pounds of initial tension in a 0.250" diameter spring, the wire diameter would have to be increased to 0.065" in diameter. A spring with this 0.065" wire diameter and 11 pound preload has one tenth the elongation range of the original 0.032" wire thus it would yield during bending and not elastically recover. In addition to the limited elongation range due to high torsional stresses wound into the wire the simple spring with it's 0.065 diameter wire has a fewer number of active coils in bending as shown in FIG. 11A and 11B.

The allowable deflection of a tightly coiled spring in bending is a function of the number of active coils involved in the bend, the amount of initial preload wound into the coil and the torsional stress developed during the bending. The amount of torsional stress developed is dependent among other things, the wire diameter used to wind the coil. If a large amount of torsion stress due to bending is encountered as would be the case with a 90 degree bend as shown in FIGS. 11A and 11B a small wire diameter would provide the lowest torsional stress and the greatest number of active coils to distribute that stress. Comparing a FTS with 11 lbs of preload versus a simple spring also with 11 lbs of preload;

FTS

Initial preload=11 lbs.

Spring diameter (Dimension A): 0.25"

Wire diameter (Dimension B) 0.032"

Number or coils per inch=1/0.032=31 angular deflection (Angle C) between coils on 0.500" dia bend radius (Dimension D)=3.1 degrees Spring Initial preload=11 lbs Spring diameter (Dimension E): 0.25"

Wire diameter (Dimension F) 0.065"

Number of coils per inch=1 /0.065=15 angular deflection (Angle G) between coils on 0.500" dia bend radius (Dimension H)=7.2 degrees With a high initial preload the amount of initial torsional stress is also high in the simple spring. Due to this high initial torsional stress there is little additional torsional stress that can be accommodated due to bending. This severely limits the amount of bending that can be accommodated without permanently deforming the spring. To add to this drawback is the fact that the individual coils must experience a greater angular deflection for a given bend radius and strut diameter as shown in FIGS. 11A and 11B. As shown in FIG. 11B the 0.065 wire diameter spring is subjected to more than twice the angular deflection per coil versus the 0.032. This additional angular deflection on top of a already high torsional stress severely limits the amount of elastic bending allowable. The simple spring shown in FIG. 11B would yield after being bent in the 0.500" bend radius shown and not be able to recover straight. The FTS on the other hand has a small amount of built in torsional stress, or none at all in the case of segmented disks, and thus has a large elastic range in bending. The added stiffness of a FTS promotes a very stiff structure when it is used in either a straight or a curved configuration yet provides the maximum elongation necessary for curved fabrication and collapse and re-erection. In addition the resistance to buckling is greatly enhanced with the additional preload because this high initial preload causes the FTS to remain very straight prior to the application of a compressive load.

When the FTS is bent a additional unique feature is exhibited. This is shown in FIG. 10. With the application of a perpendicular load, the FTS resists the load by a combination of the inherent initial preload wound into the spring and the preset preload present in the compliant sections. As the load is increased the FTS bends and in doing so compresses the compliant sections. With increasing deflection the resisting force of the FTS increases until the inner tensile member moves from the center of the assembly to the side. When this occurs the path length that the tensile member is forced to take is reduced and the deflection of the compliant sections is reduced, thus reducing the preload. This gives the FTS a over-center action latching action that is very useful during the collapse of a FTS structure and is also useful for spring biased, resetable devices such as circuit breakers etc. As shown in FIG. 10A, it takes a greater amount of force to cause the FTS to bend from a straight condition than to continue to bend it once this peak is reached. This latching/detent action promotes rapid and rigid self-erection of structures made with FTS elements. The amount of detent action and the change in slope of the force versus deflection curve is dictated by the change in path length the tensile member experiences as the FTS is bent. If the change in path length is small as would be the case in a small diameter, long spring, the detent action and slope change would be very small. If, on the other hand the spring has a large inner diameter and a short length, the path length change would be large and so would the detent action and change the in slope of the force versus deflection curve. This detent action is shown in FIG. 10A. The portion or the curve labeled A shows the initial stiffness of the FTS and at point B the trip point, (detent), is reached. Continued deflection after point B occurs with a negative spring rate. At point D the FTS once again behaves with a positive spring rate and it can be seen that it is nearly the same slope as a simple extension spring but at a higher preload. When a FTS is loaded in column as shown in FIG. 10 the force versus deflection curve is similar to that in 10A, but the trip point at B is much more pronounced and the portion of the curve at D is nearly flat. This high initial resistance to bending and subsequent very flat spring rate, (force versus deflection curve) is also ideal for human powered devices such as exercise equipment and archery equipment, since the resistance of the developed load can be tailored to the application and the resisting force can be made nearly constant across a large deflection range shown at E in FIG. 10B. In a archery bow application the behavior of the FTS in bending is similar to that obtained from "compound" bows constructed using pulleys and cables attached at various points along the bow. The FTS exhibits this high positive spring rate, negative rate and then flat or positive rate whenever it is bent regardless of the direction of the applied load. In other words the FTS will exhibit this detent action if it is loaded perpendicular to it's length as shown in FIG. 10A or along its length as a column in compression as shown in FIG. 10B or even as a simple beam loaded in the middle and supported at both ends. During collapse of a FTS structure all of these various bending modes may be encountered. As can be seen in FIG. 10A and 10B the exact shape of the force versus deflection curve and the forces obtained is adjustable by varying the preload on the tension and compression members. The areas above the simple spring curve in FIGS. 10A and 10B represent the possible adjustment ranges for a FTS.

Figure 8:
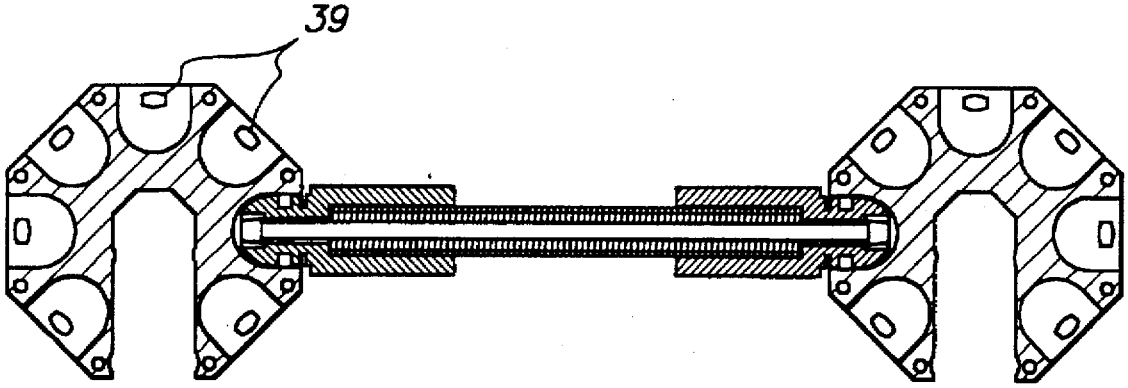
FIG. 8 is a partial cross-sectioned plan view similar to FIG. 1A of a FTS mated at each end thereof to two-dimensional couplers as seen in FIG. 5B.

Since the total amount of compliance required to allow a FTS element to bend is relatively small, super elastic materials such as nickel titanium shape memory alloys may be used for the tensile member. With this configuration a complete coil bound outer member as shown in FIG. 2B and FIG. 8 may be used without any compliant sections since sufficient compliance is available in the super-elastic tensile member. This configuration is especially useful since super-elastic alloys posses a very flat (little increase in force with increasing deflection) force versus deflection curve thus this combination would also yield a very flat force versus deflection curve. If the tensile member is composed of a split hystersis shape memory alloy a FTS structure could be stored collapsed and when desired, heated to recover the alloy and permanently lock the FTS in a straight position.

As mentioned before, it should be understood that the flexibility characteristics of the FTS including its having coaxially mounted compression and tension members are different and superior to the flexibility characteristics of say, for example, a tightly coiled elongated coil spring alone. A coil spring alone does not have sufficient stiffness to even support itself when held horizontally at one end. In contrast, the FTS will remain rigid and straight when supported at one end—even in long lengths. It is understood that it is well within the scope of the invention to reverse or eliminate the coaxial relationship of the tension and compression members 3 and 5, respectively, by mechanical expedients well known to one skilled in the art. Specifically, the combination of the tension and compression members 3 and 5, respectively, provides an overall structure when the compression member 5 is a helical spring or like functioning member, as described earlier, having some degree of compressibility that will snap back into column as compared to a spring member alone. This feature allows the unique strut of the invention to be used advantageously for self-erecting structures.

Figure 3A:
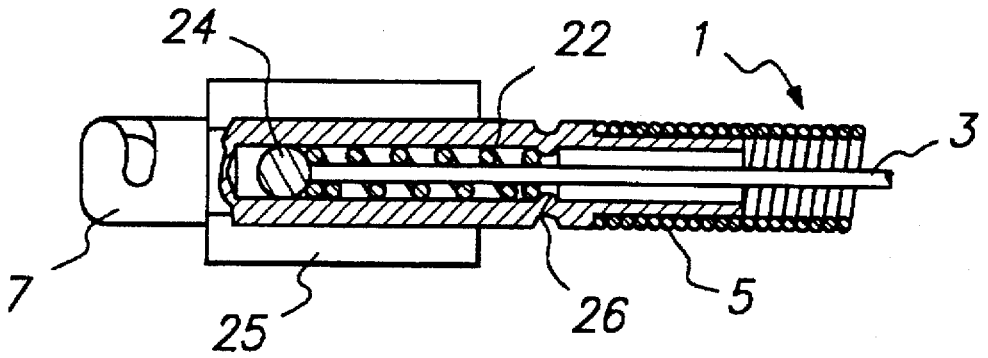
FIG. 3A is an enlarged view of an end portion of another embodiment of a FTS having alternate adjustable tension means and alternate connector means.
Figure 3B:
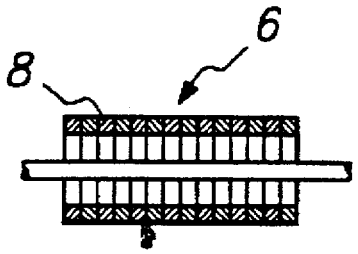
FIGS. 3B and 3C are enlarged views of a section of the FTS with alternate embodiments of compression members.
Figure 3C:
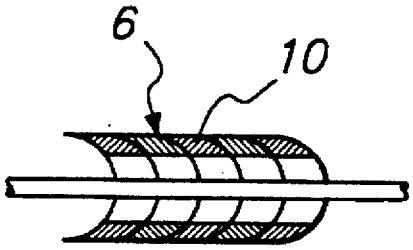

As seen in FIGS. 3B and 3C, compression member 5 may further comprise a plurality of incompressible members, shown generally at 6, such as beads or plates which when aligned or stacked on top of one another provide an incompressible column. The incompressible members 6 may be planar 8 or fitted 10, as shown in FIGS. 3B and 3C. Such members need only be strong in compression; thus they may be solid or composite, e.g., plates constructed of honeycomb sections.

For a FTS to function properly and be able to support significant compression loads the compression member segments must be aligned on top of each other. In the case where the compression member is a coil bound spring the individual coils are inherently aligned and stacked on top of each other. In the case of segmented disks, another method should be provided to proved this initial alignment. One such method is to incorporate a form fitting shape such as that shown in FIG. 3C. Another method would be to provide alignment on the tensile member itself with a close fitting disk. Yet another method would be to incorporate a magnetic alignment system by magnetizing the disks so that they align by their mutual attraction.

A variety of materials may be used for the compression member, among them are conventional spring materials such as music wire and hard drawn steel. Plastic materials may also be used such as PET (polyethylene terephthalate) which can be wound hot into a coil spring shape. Glass fiber reenforcement may be added to increase the flexural modulus and also increase the strength. If a larger preload is desired than obtainable with a plastic spring, a steel spring may be added in line with the plastic coil compression section. This plastic and steel construction is also shown in FIG. 2A with the line 27 denoting the optional transition from plastic to steel. Section 18 is steel and section 5 being plastic. If a very lightweight FTS is desired, the compression member may be composed of honeycomb material, which is extremely strong in compression yet very light weight. In general, compression member 5 may be fabricated from a variety of suitable materials such as metals or polymers or combinations of materials which will provide the compressive resistance required of the invention. It is also within the scope of the invention to fabricate the compression member 5 either structurally and/or with a choice of materials to vary the compressibility of compression member 5, e.g., combinations of compressible, variably compressible and/or incompressible members.

Figure 4:
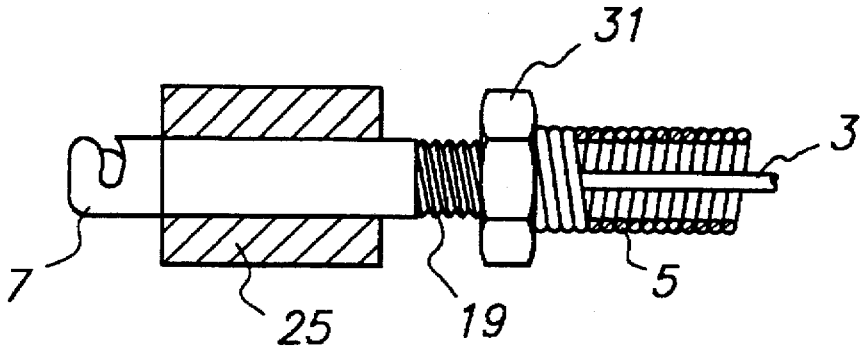
FIG. 4 is an enlarged view similar to FIG. 3A of another alternate embodiment of connector means having a jam nut to control compressibility and flexure of the FTS.

FIGS. 4 discloses mechanical means to control the compressibility of compression member 5. It is within the scope of the invention to fabricate compression member 5 of a material or materials which change in strength or dimension as desired. An example of such a material would be a recoverable shape memory alloy, e.g., a nickel titanium shape memory alloy or heat-recoverable polymeric materials or the like. It is understood that shape memory alloys include those exhibiting pseudoelasticity, superelasticity or the like, or heat recoverability.

The strength of a structure constructed from the FTS ideally is limited by the compressive load imposed upon an individual FTS. As the load on a structure is increased, the structure will remain stable until the critical buckling load of an individual FTS is reached. When this occurs the structure will partially or fully collapse. The generic Euler equation governs this buckling behavior. As known to one skilled in the art, buckling load, $F_{cr}$ $$F_{cr} = K\left[\pi^2 \frac{EI}{L^2}\right]$$

where L is the strut length (in); I is the section modulus ($in^4$); E is elastic modulus (psi); and K is a constant. For purposes of the subject invention, K equals 1. Since the strut of the subject invention is a composite structure E must be measured experimentally.

As noted earlier with respect to the subject invention, by increasing the diameter of the struts as their length increases it is possible to provide a uniform buckling factor throughout the structure. As can be appreciated the FTS will not be damaged due to buckling because it cannot develop excessive bending stresses because of its construction. Removal of the load will allow the FTS to return to its straightened shape. Likewise, a structure made of a plurality of FTS will self-erect when unloaded after being collapsed. This inherent characteristic of a structure constructed of FTS elements allows it to not only resist damage, but also allows it to be collapsed and stored for later self-erection.

As shown in FIGS. 1A and 1B, tension member 3 is preferably a cable which is flexible in bending along the length thereof but generally fixed in length to support tensile loads. The term "cable" is understood to include monofilament or multi filament for purposes of description. Tension member 3 may be a monofilament of polymeric or metallic materials or a multiple-strand cable of one or more materials as desired. It is also within the scope of the invention to have tension member 3 made of materials which also change in strength and/or dimension as desired, for example, heat-recoverable shape memory alloys or heat-recoverable polymers. It is further within the scope of the invention to make the tension member 3 from materials that exhibit a high degree of flexibility such as shape memory alloys of nickel titanium and other materials which exhibit pseudo elasticity or superelasticity. Shape memory alloys and polymers are well known to one skilled in the art, and the selection of appropriate materials for desired loading and/or motion is considered to be within the scope of this invention. Since the flexibility of the FTS, as seen in FIGS. 1A–B, is dependent upon the degree of preloaded compression of the compression member 5 determined by the tension in tension member 3, it is within the scope of the invention to vary the materials and/or mechanical interconnection of these members to control the flexibility of the FTS.

FIG. 3A illustrates the end portion of an alternate embodiment of the FTS having tension member 3 and compression member 5. In this embodiment, a spring 22 is interposed between tension member 3 and compression member 5. Specifically, at one end, spring 22 contacts stop 24 on tension member 3, and at the other end, spring 22 contacts crimp stop 26 which is in turn connected to compression member 5. Stop 24 is free to move and compress spring 22 upon flexure of the FTS. A positive limit to the amount of allowable elongation is reached when spring 22 is fully compressed.

A complete FTS assembly is shown in FIG. 1A. As seen in FIG. 2A the tensile member 3 has barbs 20 at each end. These barbs provide a snap together assembly of the connection means 7 and the tensile member. The sequence of assembly is as follows: one connector means is slipped over leader portion 21 of tensile member 3 and either pushed or pulled into snap fit collar section 9. The compression member 5 is slipped over the tension member 3 and the other connector means piece is slipped over the remaining free end of the tensile member 3. The assembly is completed by pulling on leader portion 21 until the preload/compliant sections 18 are partially compressed and barb 20 snaps into collar 9. The protruding leader portions 21 may be cut flush with the connector means after assembly. As can be appreciated, leader portions 21 are not required when the entire assembly is pressed together by aligning all of the components in line, in a fixture which prevents buckling of the compression member, and a compressive force is then applied to both ends of the assembly and this compresses the compliant sections 18 and drives barbs 20 into their respective collars. This type of assembly is possible if tensile 3 is not allowed to buckle under the assembly load prior to both barbs snapping into their collars.

In FIGS. 3A and 4 connector means 7 is shown to be a well-known quarter turn fastener. This fastener is known as a DZUS Standard Line fastener available from DZUS Fastener Co., Inc., West Islip, N.Y. It can be appreciated that both tension member 3 and compression member 5 inherently allow rotation of their respective first and second ends with respect to each other. Relative rotation occurs when first connecting one end of the FTS and then subsequently connecting the other end. It is understood that other types of connecting means such as a pin and clevis, a threaded stud and nut, etc. are within the scope of the invention. Likewise, connector means 7 may comprise the male or the female portions of any connector known to one skilled in the art that will support both tensile and compressive loads.

FIG. 2A shows an enlarged view of a portion of the FTS. As seen in FIG. 2A, compression member 5, which is shown to be a helical spring, having a portion 18 wherein the coils of the spring are spaced from each other to provide a specific amount of compliance and preload to compression member 5. The coils of expanded portion 18 abut against portion 29 of connector means 7 which is operatively connected to tension member 3. It can be appreciated that the spacing and/or strength of the coils of the compression member 5 will control the snap action of the FTS as shown in FIG. 10A.

FIGS. 3B and 3C illustrate a compression member 5 fabricated from a plurality of incompressible members 6, as discussed earlier. The members may be planar and/or fitted to each other, as seen in FIG. 3B.

FIG. 4 illustrates an alternate embodiment similar to FIGS. 2A–B wherein the compression and compliance of compression member 5 by tension member3 may be controlled and/or eliminated. In FIG. 4, the outside of connection means 7 is threaded, and compression nut 31 is provided to selectively eliminate the compliance and compress the coils of compression member 5 to reduce and/or eliminate any spacing between the coils of compressive member 5. With the embodiment illustrated in FIG. 4, the rigidity of an assembled structure of FTS can be increased subsequent to assembly by tightening compression nut 31 associated with each FTS. It is understood that other mechanical means besides threaded stud 19 and compression nut 31 are within the scope of the invention, such as a sliding sleeve, a spacer sleeve and other mechanical mechanisms that will compress the coils of compression member 5 and are well known to a person having ordinary skill in the art.

Figure 5A:
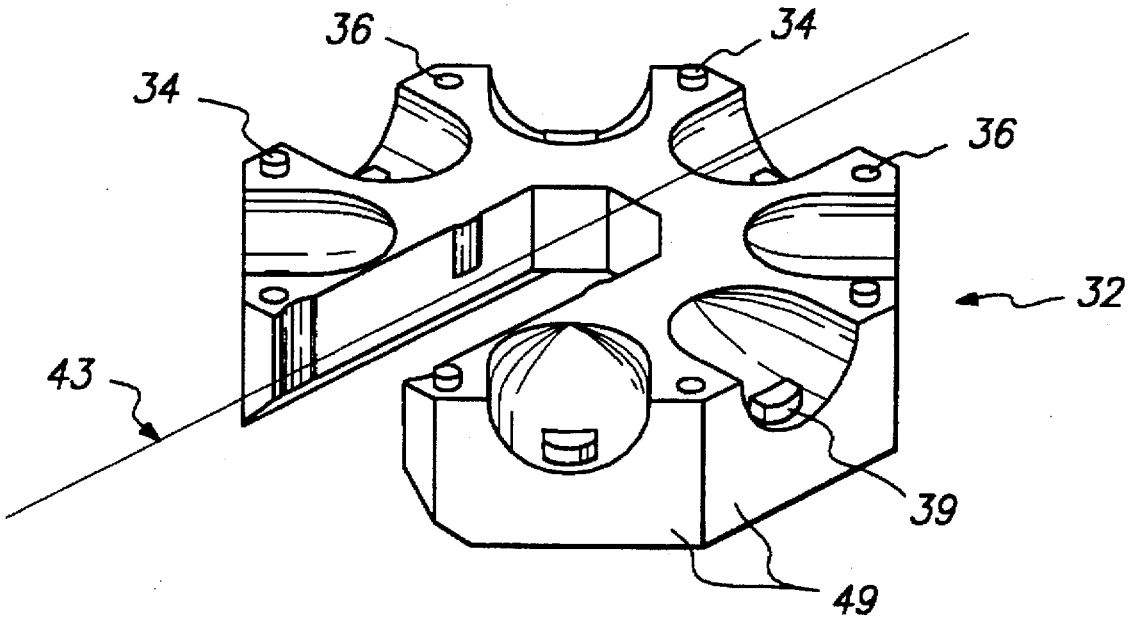
FIGS. 5A and 5B are perspective views of half of a two-dimension coupler and an assembled two-dimensional coupler, respectively in accordance with the invention.
Figure 5B:
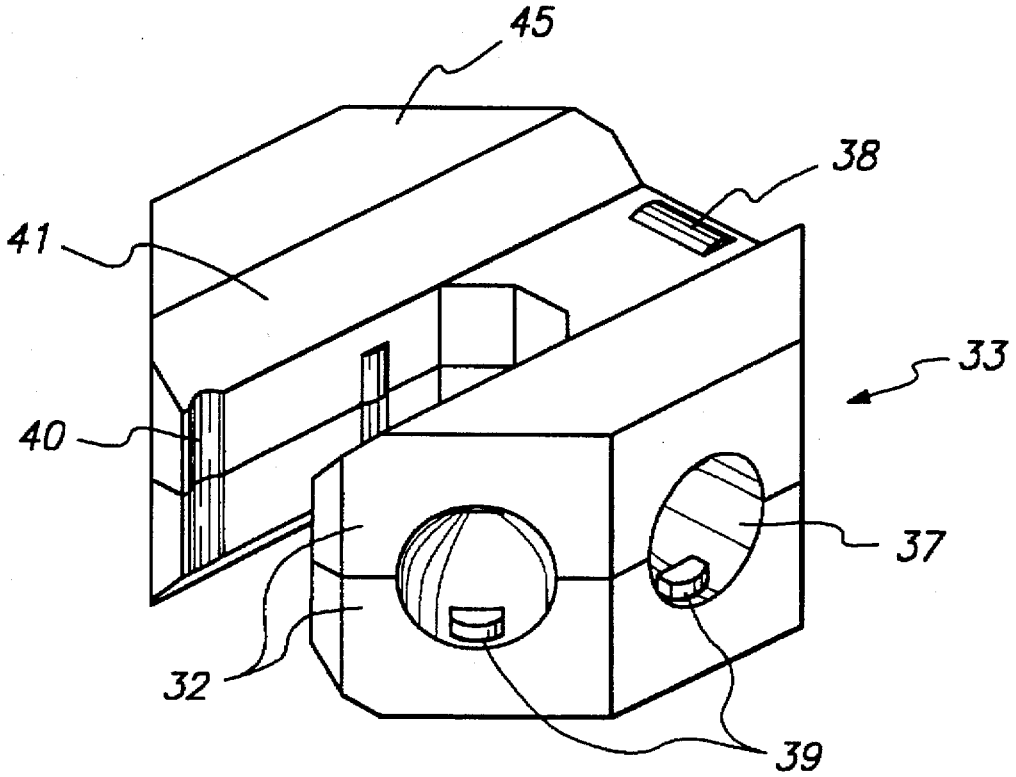

As shown in FIGS. 5A, 5B, 6A and 6B, coupler 58 is designed to take advantage of high volume injection molding. The body of coupler 33 can be made in a single piece substantially identical to that shown in 5B piece or can be made by combining two identical pieces 32 and 32 as shown in FIGS. 5A and 5B. Each piece 32 has a perimeter 49 and an axis 43 therethrough and is symmetrical about said axis. Surrounding the perimeter 49 of coupler half 32 are portions of at least one cavity 37. By manufacturing the coupler 33 in two pieces as shown, a simple two piece, inexpensive straight pull, injection mold can be used. The assembly of the pieces 32 (halves) of coupler 33 together in mirror image fashion, is facilitated by alignment pins 34 and detents 36 complementary to each other and asymmetrically located about axis 43. Other features may be used for alignment prior to bonding the two halves together such as the perimeter 49 of coupler halves 32 themselves. Coupler 33 incorporates pins 39 for engaging slot 61 in the connection means.

As previously described connection means 7 is inserted into cavity 37 by aligning slot 51 and pin 39. After insertion complete connection is obtained by rotating connection means 7, 90 degrees, until pin 39 clicks into position 55. The end portion 23 of connection means 7 can bottom out on cavity 37 providing additional support when the FTS is subjected to compressive loads. When the FTS is subjected to tensile loads, support is provided by pin 39 and wall 53. Bending loads are accommodated by the wall of the cavity 37 and the end portion 23 of the connection means 7 and rib section 59.

Figure 6A:
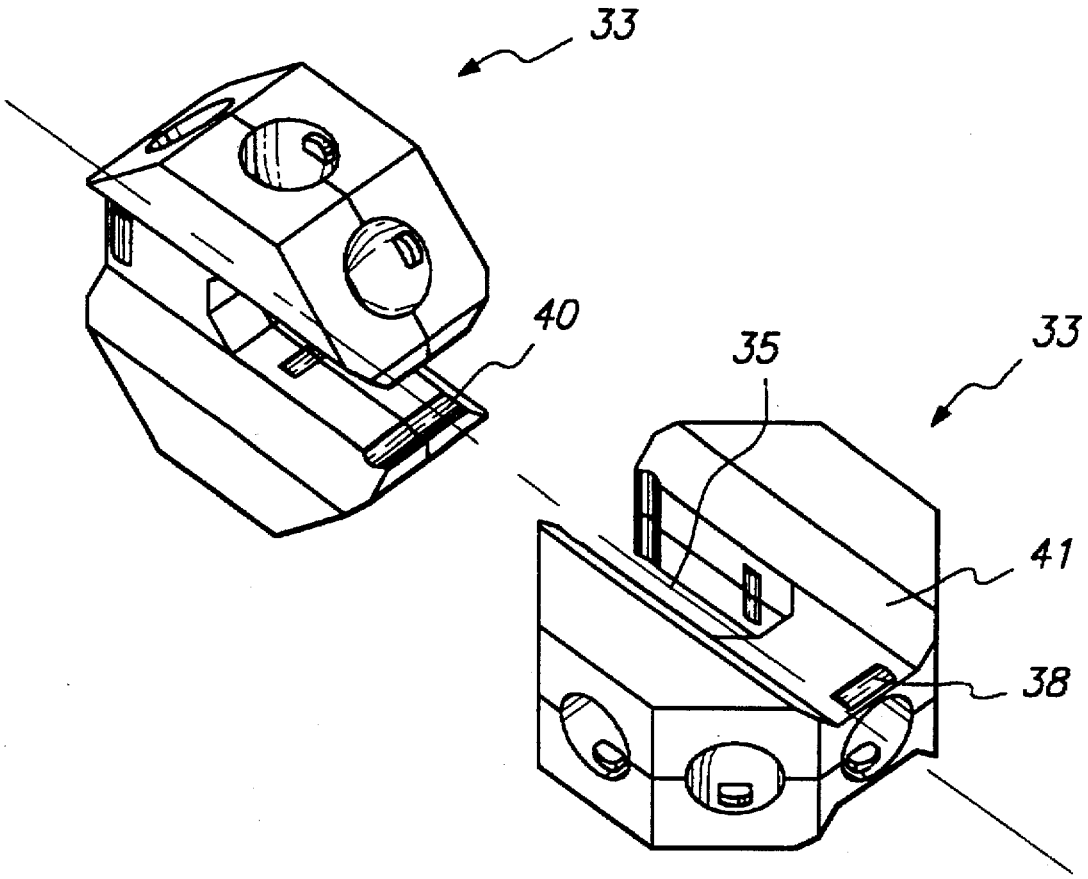
FIG. 6A and 6B are perspective views of a three-dimensional coupler.
Figure 6B:
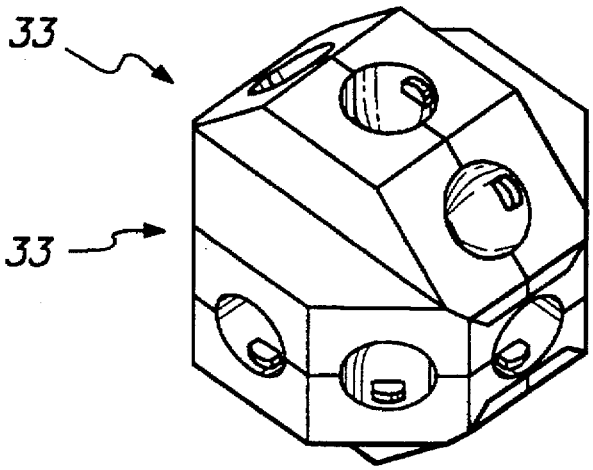

The coupler may be used in either a two dimensional configuration as shown in FIG. 5B or mated together with another identical coupler to form a three dimensional coupler as shown in FIG. 6B. Firm retention of the two couplers together is provided by bumps 38 being forced into grooves 40. As can be appreciated coupler 33 may contain any number or sides not just 8 sides as shown. In fact couplers containing 3 or 6 sides are especially useful for creating geodesic domes etc. Due to the flexibility of struts 1 any combination of different sided couplers may be used during construction since the struts are flexible and not restricted to fabrication using only combinations of right triangles as in other construction toys.

As shown in FIGS. 6A and 6B, coupler slot 35 is a location means for the two couplers 33 relative to each other. This beveled slot 41, extending from the perimeter 49 and being symmetrical about the axis 43 provides alignment during mating of the two couplers and can also be used to mate to other, differing coupler pieces. The depth of this slot should be at least to the centerline of the coupler and preferably past the centerline so that other segments may be inserted into this slot and their centerline coincide with that of the coupler. This groove depth passing beyond the centerline of the part is in contrast to the prior an teachings of Willis U.S. Pat. No. 3,564,758 which states that the slot thickness should be less than half the length of the corner radius. The thickness of the coupler shown in FIG. 5B is substantially greater than the slot width. This feature is in contrast to the prior an teachings of Nelson U.S. Pat. No. 2,633,662 and Glickman U.S. Pat. No. 5,199,919 that teach that the part thickness is less than the slot width. With the greater part thickness of the instant invention the assembled couplers assume a spherical appearance rather than the snow-flake appearance of the prior art. In addition, after mating the two piece composite coupler is able to withstand loads in all directions including off center loads and bending loads. The two couplers can be demated however, by applying sufficient force to overcome the detent action of bumps 38 and grooves 40. Each piece 32 is provided with bumps 38 and grooves 40 which are complementary to each other and symmetrical bout axis 43. The coupler is able to withstand the significant loads encountered when a structure is collapsed and subsequently is allowed to re-erect itself. This ability to be collapsed and re-erect itself is possible due to the unique nature of the FTS combined with coupler 33.

Figure 9:
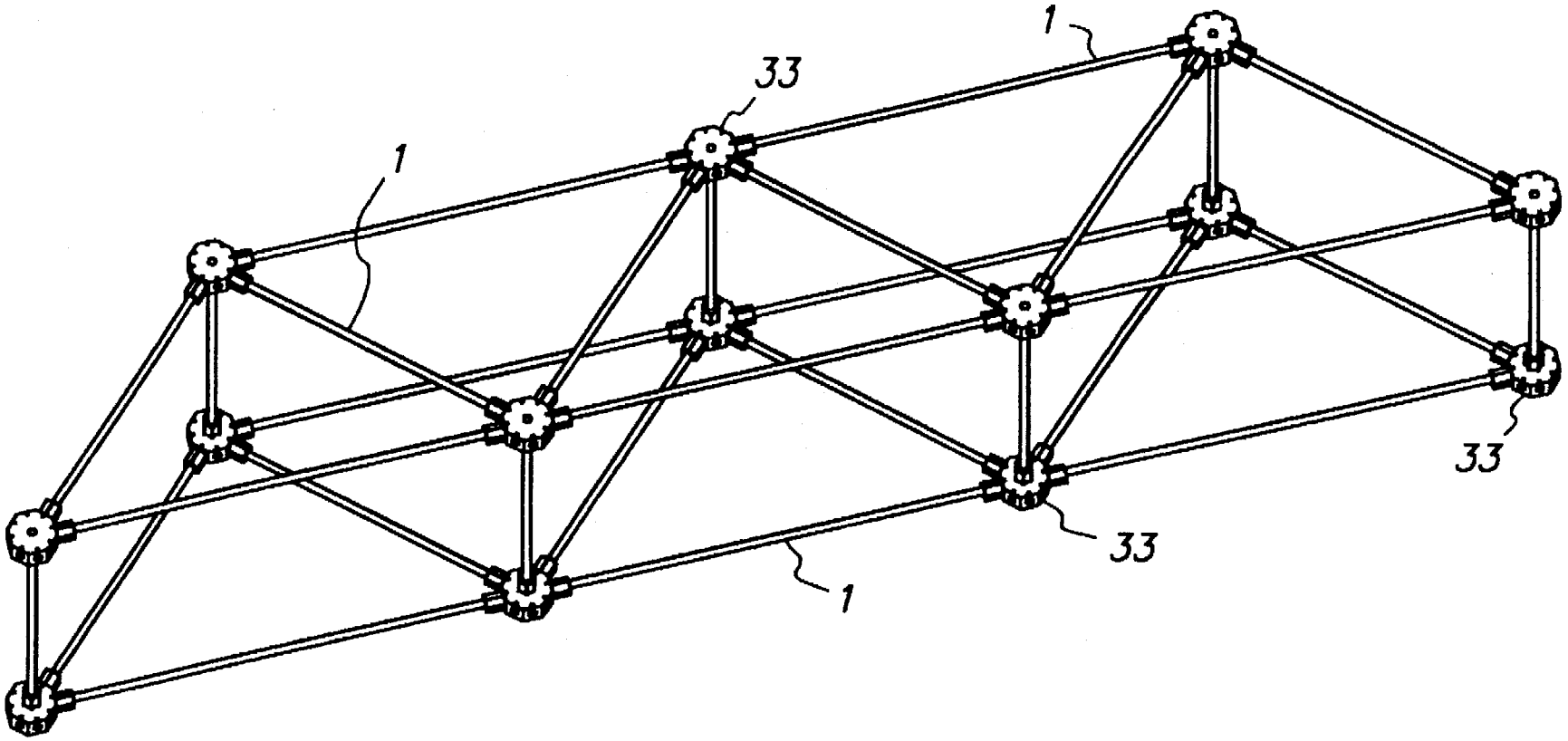
FIG. 9 is a perspective view of a self-erecting structure of multiple FTS and alternate embodiments of three-dimensional couplers in accordance with the invention.

Prior art hub type couplers are not designed to accommodate all of the various loads encountered by the FTS when it is subjected to loads and/or collapse. For example Glickman in U.S. Pat. No. 5,199,919 discloses a hub type connector that can support small compression or tension loads but no bending loads. In fact, mating and demating of the struts and hubs is accomplished by bending the strut relative to the hub. Earlier type hub and strut toys such as Benjamin, U.S. Pat. No. 2,709,318, Pajeau, U.S. Pat. No. 1,113,371 and Ferris, U.S. Pat. No. 1,843,115 disclose hubs with holes for attaching struts by forcing a strut into a under size hole. Removal is accomplished by pulling on the strut thus pulling it out of the hole. This type of attachment method, since it cannot accommodate supporting tensile loads would not be suitable for the FTS which experiences compressive, tensile and bending loads during assembly and during any subsequent external loading or collapse. The hub strut connection system shown in FIG. 9 is able to accommodate these various loads without demating and thus provide a rugged structure that can even be collapsed without demating and compromising the structural integrity of the structure.

Other rugged connection systems are disclosed in the prior art such as the nut and bolt arrangement disclosed by Gugliotta in U.S. Pat. No. 3,882,650 but this system is obviously cumbersome and time consuming and would never be tolerated by a child in a building set. The connection system disclosed in Ono U.S. Pat. No. 3,864,049 can support tension and compression and is quickly connected, but by virtue of its design in order to support tension, it cannot be demated once mated. Since the FTS can be bent in order to insert it into a coupler hole, the building sequence used during construction of a structure is not important. In other words the builder will not have to remove a piece of the structure in order to fit another because the FTS pieces are bendable and in addition the two end pieces rotate independent of each other thus allowing mating of one end without interfering with the other. In order to allow maximum flexibility of a FTS structure, ball and socket joints could be used in order to provide the smallest joint possible. A collapsible structure is disclosed in Adams U.S. Pat. No. 4,958,474. This system uses rigid struts with flexible joints to allow collapse where as the FTS system uses flexible struts to provide flexibility. In addition the system of Adams does not possess an energy storage system activated during collapse, thus cannot self-erect due to storage of energy.

It can be appreciated that the coupler 33 can have a plurality of openings 37 to accommodate the connection of struts in all three dimensions. It can be appreciated that the top surface 35 of the member 33 can be contoured and provided with further openings (not shown) to accommodate struts at angles to surface 45 other than perpendicular.

Figure 7:
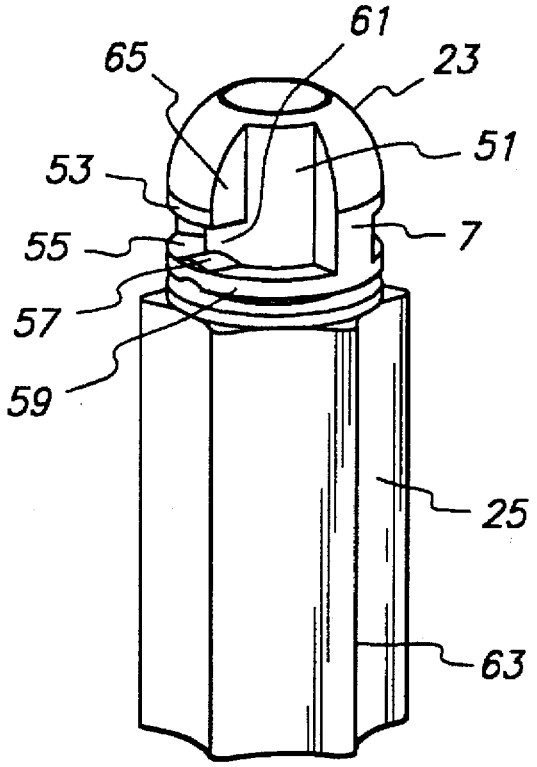
FIG. 7 is an enlarged perspective view of one end of the connector means of the FTS shown in FIG. 1A.

As shown in FIGS. 7 and 8, connector means 7 provides for transmitting tensile, compressive and bending loads to be applied to the couplers and the entire structure. To facilitate easy and fast connection to the couplers the end pieces require only a 90 degree rotation (quarter turn) to completely engage and lock in place. This locking action is provided by the action of the coupler tooth 39, extending to engage a connector, being rotated past ramp 57 and into final position 55. The action of tooth 39 sliding though ramp section 57 proves a tactile and audible click confirming to the user that the end piece has been fully mated. As is shown in FIGS. 7 and 8 tooth 39 is wider than slot 61. As the connector means 7 is rotated and tooth 39 is forced into ramp section 57 and circumferential rib 59 is deflected and then snaps back into its original position after tooth 39 completes its travel into its final position at position 55. It is understood that rib 59 need not extend around the complete circumference of connection means 7. The stiffness of rib 59 determines the amount of force required to fully mate connector means 7 into coupler 33. Connector means 7 has been specially designed to incorporate locking collar section 9, entry section 51, spring rib section 59, ramp section 57 and grasping section 25 all into a single injection moldable piece. In addition the design of the external portions is such that they can be molded in a simple two piece mold that opens in a straight pull without elaborate multi- axis slides. This is very advantageous in order to keep the mold tooling costs down to a reasonable level. In order to incorporate entry portion 51 and ramp portion 57 in a design that is moldable in a two piece mold, that retracts in a single direction, these features must not contain any under-cuts that would prevent the removal of the connection means after molding. This is accomplished by aligning the walls of slot 51 parallel to parting line 63 and second wall 65 perpendicular to parting line 63. The walls of slot 51 are perpendicular to slot 61 including ramp 57 and rib 59. As can be appreciated the angle these features have with respect to parting line 63 need not be exactly parallel or perpendicular to parting line 63 but they must not create undercuts, i.e., portions of the end piece that are narrower at the bottom than the top.

A strut mated to two couplers is shown in FIG. 8. FIG. 9 illustrates a structure fabricated from a plurality of flexible tie struts 1 and couplers 33. It can be appreciated that each FTS, even after assembly, can be flexed, as shown in FIG. 1, and the entire assembly compressed.

FIGS. 10A and 10B illustrate the force versus deflection curves for a flexible tie strut and spring loaded as a cantilever and in column. These FIGURES were discussed at length to illustrate the advantages of the FTS over a simple spring.

FIG. 11A illustrates a FTS compression member with 11 pounds of preload bent into a 0.500 inch radius. FIG. 11B illustrates a spring with 11 pounds of preload bent into a 0.500 inch radius.

Figure 12A:
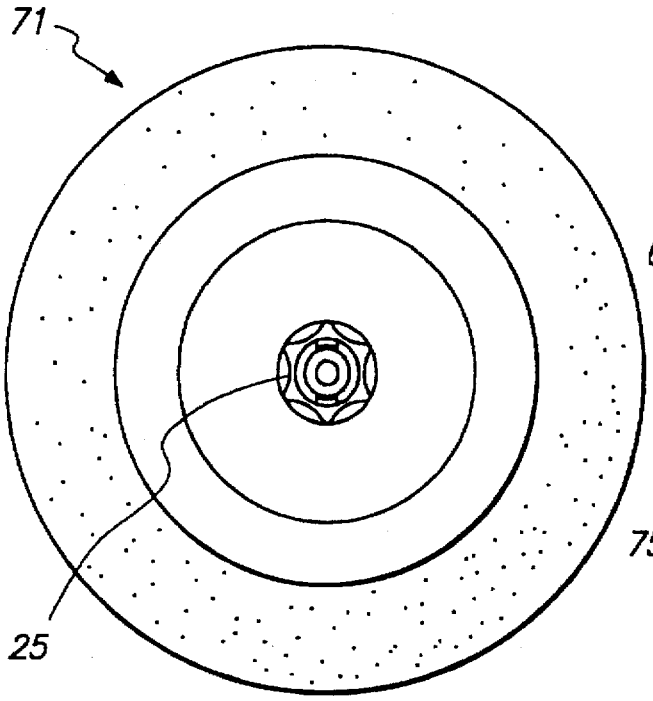
FIG. 12A illustrates in end view a wheel assembly and axle-like member with integral connection means.
Figure 12B:
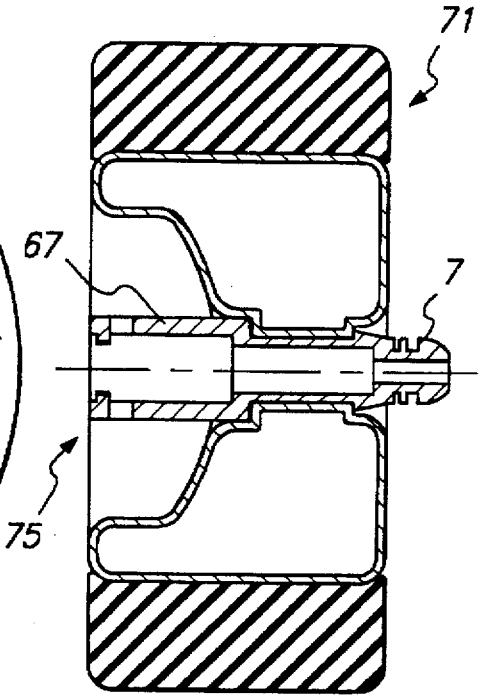
FIG. 12B illustrates in cross section view the wheel, axle and connection means shown in FIG. 12A.
Figure 13:
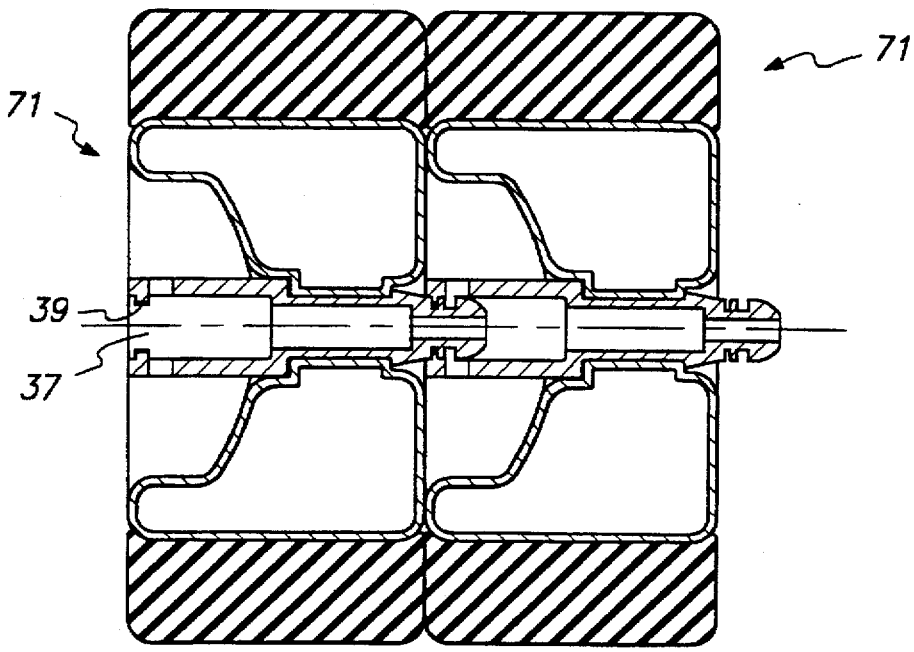
FIG. 13 illustrates a mated tandem pair of the wheel assembly, axle and the axle-like members shown in FIGS. 12A and 12B.

FIG. 12 illustrates a wheel assembly with wheel 71 in FIGS. 12A and 12B which utilizes an axle-like member 67 which includes both male and female connection means shown at 7 and 75, respectively. Female connection means 75 comprises cavity 37 and tooth 39, similar to that used in coupler 33. Male connection means 7 is a quarter-turn connector similar to that used for the FTS.

Modifications and variations of the present invention will be apparent to those having ordinary skill in the an having read the above teachings, and the present invention is thus limited only by the spirit and scope of the following claims.

What is claimed is:

1. A coupler comprising a body of two identical pieces, each piece having a generally planar mating surface and having a perimeter and having an axis therethrough and being generally symmetrical about said axis, each piece having a portion of at least one partial cavity in the perimeter thereof and in the generally planar mating surface, said pieces being connected together by contact of said mating surfaces in mirror image and coplanar fashion joining said portions to form said body having a complete cavity in the periphery thereof to form a two-dimensional connector.

2. A coupler as in claim 1 wherein each said piece has alignment projections and detents which are asymmetrical about said axis, said projections and detents being complementary to each other to provide alignment for assembly of each piece to each other.

3. A coupler as in claim 1 having a beveled slot in each piece extending from the perimeter of each piece and being symmetrical about said axis, said beveled slots having beveled surfaces providing alignment of said body to an identical body of identical pieces to form a three-dimensional coupler, the beveled surfaces contacting each other to provide continuous alignment and stability when formed as a three-dimensional coupler.

4. A coupler as in claim 1 wherein each said piece has bumps and grooves which are symmetrical about said axis, said bumps and grooves being complementary to each other to provide for retention of said body to another body.

5. A coupler as in claim 1 wherein said cavities have at least one tooth extending into said cavity to engage a connector means of a tie strut to be mated to said coupler.

6. A self erecting system comprising a flexible tie strut for supporting both compressive and tensile forces having a first connector means attached to the first ends of said tension member and said compression member and a second connector means attached to said second ends of said tension member and compression member to connect said flexible tie strut to objects to be connected and having a coupler having a body of two-identical pieces, each piece having a perimeter and having an axis therethrough and being generally symmetrical about said axis, each piece having a portion of at least one cavity in the perimeter thereof, said pieces being connected together in mirror image fashion to form said body having cavities in the periphery thereof to form a two-dimensional connector.

7. A system as in claim 6 wherein said connector means includes a flexible tie strut wherein said connector means includes at least a portion of a circumferential resilient rib, said rib being deflected upon mating of said strut.

8. A self erecting system comprising a flexible tie strut for supporting both compressive and tensile forces having a first connector means attached to the first ends of said tension member and said compression member and a second connector means attached to said second ends of said tension member and compression member to connect said flexible tie strut to objects to be connected and having a coupler having a body of two-identical pieces, each piece having a perimeter and having a coupler having a perimeter and at least one cavity, in said perimeter, said cavity having at least one tooth extending into said cavity to engage a connector means of a tie strut to be mated to said coupler.

9. A system as in claim 8 wherein said connector means includes a flexible tie strut wherein said connector means includes at least a portion of a circumferential resilient rib, said rib being deflected upon mating of said strut.

10. A wheel assembly comprising:

at least one wheel having a rotational axis and having an opening therethrough concentric with said axis; and an axle-like member permanently mounted within said opening, said axle-like member having connector means integral with each end thereof, said connector means being a quarter-turn connector at one end and a cavity that is complimentary in dimension to said quarter turn connector having at least one tooth at the other end thereof.

* * * * *